US007266978B2

(12) United States Patent
Stingel et al.

(10) Patent No.: US 7,266,978 B2
(45) Date of Patent: Sep. 11, 2007

(54) KNITTING TOOL

(75) Inventors: Uwe Stingel, Messstetten (DE); Eric Jürgens, Bisingen (DE)

(73) Assignee: Groz-Beckert KG (DE)

( * ) Notice: Subject to any disclaimer, the term of this patent is extended or adjusted under 35 U.S.C. 154(b) by 0 days.

(21) Appl. No.: 11/524,423

(22) Filed: Sep. 21, 2006

(65) Prior Publication Data

US 2007/0130997 A1 Jun. 14, 2007

(30) Foreign Application Priority Data

Sep. 22, 2005 (EP) ..... 05020630

(51) Int. Cl.
*D04B 35/06* (2006.01)

(52) U.S. Cl. ..... 66/120

(58) Field of Classification Search ..... 66/116–124
See application file for complete search history.

(56) References Cited

U.S. PATENT DOCUMENTS 1,385,929 A * 7/1921 Scott ..... 66/116
1,468,518 A * 9/1923 Scott ..... 66/121
RE15,741 E * 1/1924 Scott ..... 66/13
1,483,009 A * 2/1924 Page ..... 66/120
1,563,233 A * 11/1925 Scott ..... 66/120
6,609,398 B2 * 8/2003 Plath ..... 66/120
6,854,295 B2 * 2/2005 Hofmann ..... 66/120
6,895,784 B2 * 5/2005 Hofmann ..... 66/120

FOREIGN PATENT DOCUMENTS

DE 196 41 338 A1 4/1998
DE 102 11 231 C1 4/2003
GB 186 405 A 9/1922

* cited by examiner

*Primary Examiner*—Danny Worrell
(74) *Attorney, Agent, or Firm*—Venable, LLP; Raymond J. Ho

(57) ABSTRACT

A knitting tool which is suitable for embodying both large and small loops has two needles (6, 7), disposed coaxially to one another, whose hooks are oriented identically. The hook of the larger needle (6) is split in two in the middle and comprises hook halves. The finer needle (7) can be driven between the two hook halves upon spreading of the two hook halves apart from one another. For selectively closing the hooks, a slide is provided, which can be brought into engagement both with the tip of the fine needle and with the tip of the coarser needle. To raise and lower the slide to the various positions of the hook tips relative to the needle back, a sliding control block may be provided. The sliding control block may be embodied on the coarse needle and the fine needle (7).

22 Claims, 6 Drawing Sheets

Figure 1:
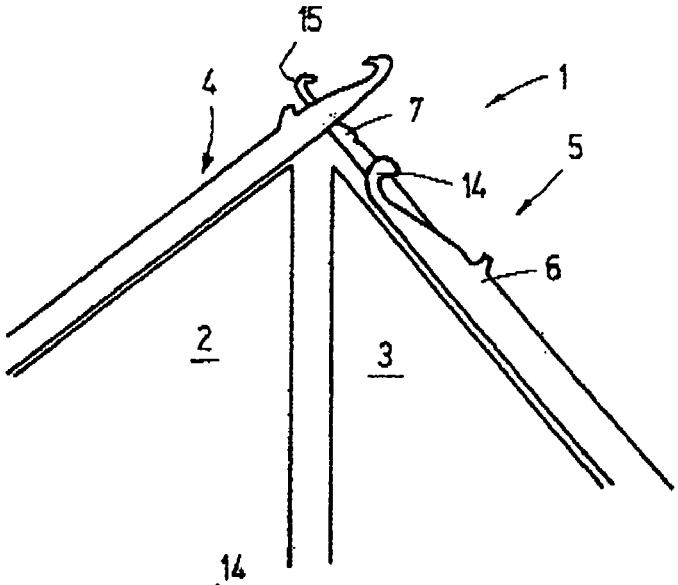

STRICKVORGANG:
GROBE NADEL

STRICKVORGANG:
FEINE NADEL
5
6
7
12
14a
14b
15
16
17
18
19
23
24
26
30
31
32
38
39

UEBERTRAG:
FEINE NADEL AUF GROBE NADEL 12
6
7
40
32
31
19
15
14
14a
14b

UEBERTRAG:
GROBE NADEL AUF FEINE NADEL 7
6
12
19
14
40
35
31
32
15

KNITTING TOOL

The invention relates to a knitting tool, which is suitable in particular for flat knitting machines but in principle also for other loop-forming devices in machines as well.

For creating knitted goods that are not uniform throughout, it is often desirable to vary the size of individual loops or rows of loops during the knitting process. This can be desired for the sake of creating patterns or achieving other optical and/or fashionable effects.

Ideally, knitting tools with coarse hooks are used for forming large loops, while for forming small loops, knitting tools with fine hooks are used.

It would then be obvious to equip knitting machines with knitting tools which have the ideal hook shape and size for the desired loop size. This would have the major disadvantage that forming the loop size would depend entirely on the individual equipping positions of the needles, and that the patterning capability would thus be restricted considerably. With a knitting machine needle which is designed for forming small loops, it is not possible to form large loops; the ratios between the loop head, loop base and loop leg would be disproportionately increased. This leads to poorer-quality goods. Therefore knitting machines are conventionally equipped with uniform tools; that is, the loop-forming parts of the knitting tools are identical. A compromise is made here in equipping the knitting machines with needles. The hook size chosen is between the ideal dimension for large loops and the ideal dimension for small loops; in other words, a middle hook size is used. Once again, this leads to knitted goods which contain loops whose construction (loop head, loop base, loop leg) does not match the ideal concept of a high-quality knitted product.

In addition, using a uniform loop-forming part of a knitting tool for large and small loops means restrictions in varying the formation of loop sizes, the choice of yarns, and the yarn thickness.

It is furthermore possible, for forming different loop sizes, for individual needles to be intentionally not projected, or in other words to cause them not to participate in the loop-forming process. The result is asymmetrical loops and hence asymmetrical knitted products. For instance, such loops then have a loop base that is larger than the loop head, which means a restriction in terms of designing the appearance of the resultant knitted product.

It is the object of the invention to disclose a knitting tool with which a more-variable design of knitted goods is possible.

This object is attained with the knitting tool as defined by claim 1:

The knitting tool of the invention has a first needle and a second needle, each with a hook, and a closing element, which is associated both with the hook of the first needle and with the hook of the second needle and can thus serve to selectively close or open the hooks of the two needles. The hooks of the two needles are oriented in the same direction; that is, they are curved in the same direction and with the same directional orientation. As a result, they can take on loops, with a knitted product suspended from them, without requiring special additional provisions for holding the loops in the hook interior.

Preferably, the two needles are of different sizes. As a result, the first, larger needle can be used to create larger loops, and the second, smaller or finer needle can be used to create smaller loops. The loops created can then be symmetrical in each case, or in other words can have an approximately equal-size loop head and loop base. This expands the possibilities for designing knitted goods, compared to conventional loop-forming systems. It is additionally possible to employ a greater variety of both yarns of different thickness and yarn types. Large needles can process thick yarns and so-called effect yarns; small needles can process fine yarns.

Preferably, the first, larger needle has a receiving chamber for the second, smaller needle. Preferably, the receiving chamber embodied between two side walls of the larger needle has a height which is greater than the height of the smaller needle, so that the side walls protrude past the smaller needle. Preferably, the height of the side walls is at least as great as the height of the small needle. The height is measured crosswise to the direction of motion of the knitting tool, perpendicular to the bottom and parallel to the walls of the receiving chamber.

The smaller needle, especially whenever it is located centrally relative to the larger needle, can create smaller loops at the same point where otherwise the larger needle creates larger loops. This is in response to a demand that usually exists with regard to designing knitted goods. It is furthermore possible for the combined knitting tool, including both needles, to cooperate with another knitting tool, such as a simple machine knitting needle, located for instance diametrically opposite the combined knitting tool. The cooperation, or in other words the loop transfer or takeover can then be done both with the first, large needle of the knitting tool and alternatively with the second, smaller needle of the knitting tool. A crosswise offset between two corresponding, diametrically opposed needle beds from one another is then unnecessary.

The knitting tool of the invention may cooperate with simple needles, whose size corresponds to the size of the larger needle of the combined knitting tool. The knitting tool of the invention can furthermore cooperate with simple needles whose size corresponds to the size of the smaller needle of the combined knitting tool. The combined knitting tool can furthermore cooperate with a simple needle whose size deviates from both the size of the larger needle and the size of the smaller needle of the combined knitting tool. With all the combinations mentioned, specific knitted product forms are each created, forms that can be desired from one case to another.

The knitting tool of the invention can furthermore cooperate with a knitting tool which is likewise embodied as a combined knitting tool and includes a larger and a smaller needle. The larger needles of the two cooperating combined knitting tools can either be the same size or have a size differing from one another. The smaller needles of the two combined knitting tools can also be the same size as one another or have a different size from one another.

In order to be able to change not only the size of the loops created but also their number within a row of loops in a piece of knitted goods during the knitting process, it is advantageous if knitting tools of the invention and simple needles are located in mixed fashion in a needle bed. The simple needles can then have a size which matches the larger of the two needles of the combined knitting tool. They can furthermore have a size that matches neither the size of the larger needle nor the size of the smaller needle of the combined knitting tool. Preferably, they have a size which matches the size of the smaller needle of the combined knitting tool. Also preferably, combined knitting tools of the invention are each located in alternation with simple needles.

The individual needles of the tool according to the invention, that is, the large and small needles, can be used separately as simple needles. For instance, the smaller needle with the same slide can be used as a simple needle, as a separate knitting tool in a track. If the large needle is used as a simple needle (without an additional small needle), a suitably modified slide is necessary.

The first, larger needle preferably has a hook which is split along an imaginary separation plane that is central and parallel relative to the flat sides of the larger needle. The two hook halves are then supported by spring legs. Preferably, the latter are embodied in such a way that the hook halves touch and rest flatly against one another. The final needle can force the two spring legs and hook halves apart and thus punch through between them. The same is true for the closing member, which is preferably embodied as a slide. The hook halves are spread apart by the finer needle and/or the slide. To that end, it is expedient in particular if the receiving chamber for the finer needle is aligned with the hook of the larger needle.

Not only the two needles but also the slide are each provided with their own drive mechanism. This device may be formed by a butt or a coupling device. A butt is formed for instance by an extension protruding away laterally from the respective element and in engagement with a cam of a knitting machine. The desired motions of the needles and slide can thus be generated. The coupling device provided as an alternative or in addition couples the applicable element, for instance to a coupling part which is supported displaceably in a needle track and is in engagement in turn with a suitable drive mechanism, such as a knitting cam. It is furthermore possible to drive the needles directly with suitable drive means, so that they execute the desired reciprocating motion.

Both on the first and second needles and on the closing member, loop support devices may be provided. These are formed for instance by suitable protrusions protruding away from the respective element transversely to the direction of motion. The closing member embodied as a slide can for instance be supported displaceably on the second needle and to that end can be received by a track embodied in the smaller needle. It is also possible to support the slide on the larger needle. Preferably, the slide has a width that matches the width of the smaller needle. However, the widths may also deviate from one another.

The slide preferably cooperates with both the hook of the first needle and the hook of the second needle. To that end, it is preferable to move it not only in the longitudinal direction but also in the transverse direction or vertical direction. The term "vertical direction" is understood here to mean a direction that is at an angle to the longitudinal direction of the needle. The motion in the vertical direction serves to position the tip of the slide at the various positions of the two hooks of the two needles. The transverse or vertical motion can be accomplished by means of a suitable sliding block embodied on the larger and/or the smaller needle. Preferably, the larger needle has a recess at its tip for receiving one end of the slide. The hook of the smaller needle may also be provided with a corresponding recess, and to which the end of the slide fits. Alternatively, the slide may be embodied such that it fits over the smaller needle in order to close the hook interior of that needle.

Further details of advantageous embodiments of the invention will become apparent from the drawings, description or claims.

In the drawings, one exemplary embodiment of the invention is shown.

Figure 2:
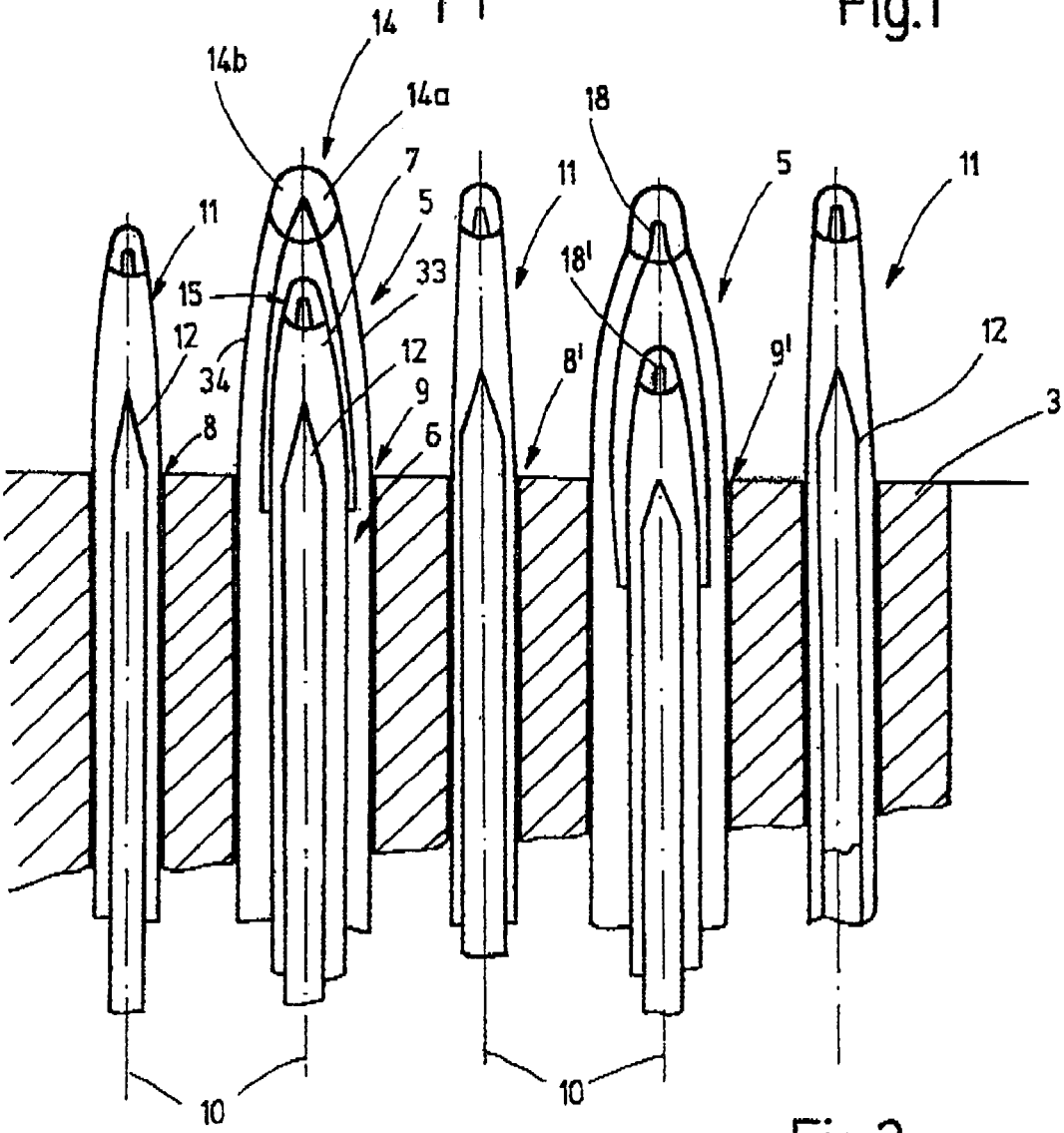

FIG. 1, in a schematic side view, shows two needle beds of a knitting system on the order of a flat-bed knitting machine;

FIG. 2, in a schematic, fragmentary top view on a different scale, shows a needle bed of the knitting system of FIG. 1;

FIGS. 3 through 6, in schematic side and top views, show a knitting tool of FIGS. 1 and 2 in different positions during knitting using the larger needle there;

FIGS. 7 through 10, in side and top views and in various operating positions, show the combined knitting tool of FIGS. 1 through 2 in knitting with the finer needle there;

FIGS. 11 through 15, in side and top views, show the combined knitting tool of FIGS. 1 through 10 in various work positions for transferring a loop from the fine needle to the coarse needle inside a combined knitting tool;

FIGS. 16 through 20, in side and top views, show the combined knitting tool of FIGS. 1 through 15 in various work positions for transferring a loop from the coarse needle to the fine needle inside a combined knitting tool; and FIGS. 21 through 25, in a side view, show the combined knitting tools of FIGS. 1 through 20 in various work positions for transferring the loop from the coarse needle of one needle bed to the fine needle of the diametrically opposed needle bed.

In FIG. 1, a knitting system 1 is shown, with two needle beds 2, 3 in which knitting tools 4, 5 are each held longitudinally displaceably. While the knitting tool 4 is a simple conventional compound needle or some other conventional needle or the fine needle of the combined knitting tool 5, the knitting tool 5 is a combined knitting tool which includes both a first, large or coarse needle 6 and a second, small or fine needle 7. Both knitting tools 4, 5 cooperate for making a knitted product. The knitting tool 4 may also be embodied as a combined knitting tool, like the knitting tool 5.

FIG. 2 shows the needle bed 3 in a top view. The needle bed includes a plurality of needle tracks 8, 9, 8', 9' parallel to one another. The parallel needle tracks 8, 9, 8', 9' can each have one larger and one smaller width in alternation, the width being measured in each case between the needle track walls. The result is a preferably uniform pitch, represented by the dot-dashed line 10.

The narrower needle tracks 8, 8' preferably have simple, conventional compound needles of relatively fine pitch seated in them. For instance, the needle gauge may be E10. Their width, also called needle thickness, then amounts to 0.9 mm. To that end, the fine needle 7 together with the slide 12 may be used.

Conversely, the knitting tools 5 supported in the wider needle tracks 9, 9' are novel knitting tools, which besides the two needles 6, 7 already mentioned also include a closing member, for instance in the form of a slide 12. The needles 6, 7 and the slide 12 are supported displaceably relative to one another in the longitudinal direction of the line 10, or in other words in the longitudinal direction with the needle track. The two needles 6, 7 each have a respective hook 14, 15. If the gauge of the second, smaller needle 7 is E10 (needle thickness=0.9 mm), then it has a hook height of 1.9 mm, for example. The hook height should be measured perpendicular to the bottom of the needle track 9, or to the needle back. The gauge of the coarse needle 6 is E5, for example, and thus it has a needle thickness of 1.6 mm and a hook height of 3.2 mm.

Figures 3, 4, 5, 6:
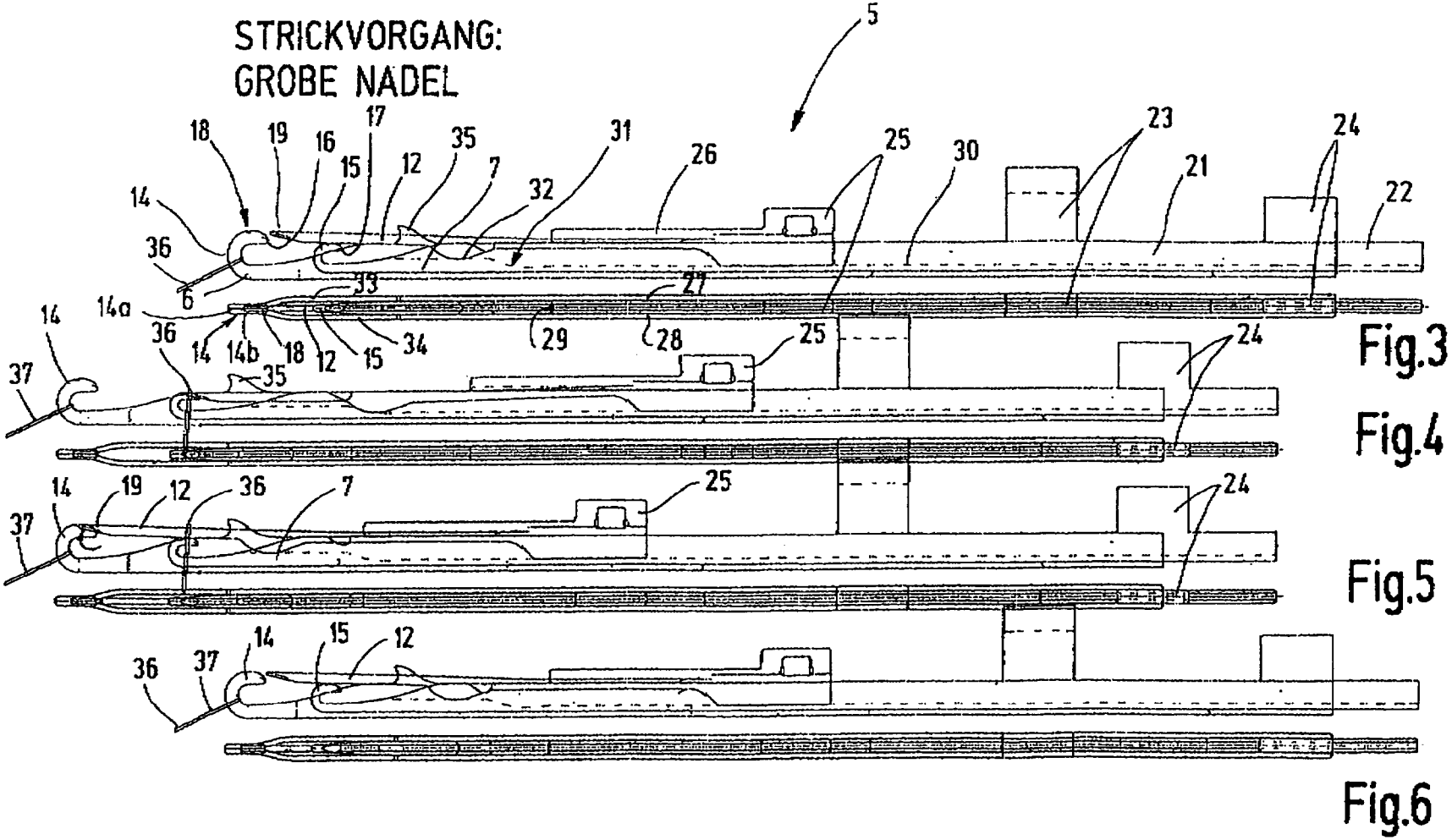

The basic construction of the knitting tool 5 is further shown in FIG. 3, in the upper half of which a basic sketch of the knitting tool 5 is shown in a side view and in the lower half of which a top view on the knitting tool 5 is shown. In the side view, to improve clarity, the smaller needle 7, received in a recess in the larger needle 6, is also shown in solid lines; that is, the first needle 6 is shown as if it were transparent. In that sense, FIG. 3 is entirely schematic.

As can be seen, both hooks 14, 15 are curved in the same direction, that is, in the plane of the drawing or in other words parallel to the flat sides of the needles 6, 7. The curvature furthermore has the same directional orientation, which in FIG. 3 is clockwise. The hooks 14, 15 each have a respective tip 16, 17, and the tips point in the same direction. At least the hook 14, and preferably the hook 15 as well, has a flutelike or slotlike recess on its end remote from the needle back; in this art, this recess is also known as a noucat 18. The noucat serves to receive the pointed end 19 of the slide 12.

Both the needle 6 and the needle 7 have a shank elevation adjoining the hooks 14, 15 and then change over into a needle shank 21, 22, respectively. Each shank 21, 22 has a butt 23, 24, acting as a drive mechanism for accomplishing a longitudinally oriented driving motion. The slide 12 is likewise provided with a butt 25. In precise terms, the butt 25 is embodied on a receiving element 26, on which the slide 12 is held.

The small needle 7 slides in the slotlike receiving chamber, visible in FIG. 3 and extending longitudinally through the large needle 6, and is thus held between lateral legs 27, 28 of the large needle 6. In turn, the small needle also has a slot 29, in which the slide 12 is supported longitudinally displaceably. The slot 29 has a slot bottom 30, which is shown in dashed lines in the upper side view in FIG. 3. The slot bottom 30 is substantially flat. On its front end, oriented toward the hook 15, it has a raised area, for instance in the form of a ramp 31, on which a protrusion 32 of the slide 12 slides in order to move the slide 12 vertically or obliquely to the longitudinal motion, that is, away from the needle back and onto it. This serves, with the end 19 of the slide 12, to close either the hook 15 or the hook 14.

From the legs 27, 28, spring legs 33, 34 lead to the hook 14. At the beginning of the spring leg 14, on at least one of the two spring legs 33, 34 and preferably on both, a respective loop support 35 is embodied, in the form of an extension protruding upward away from the needle back, and in the exemplary embodiment this is a hooklike extension.

The spring legs 33, 34, as the top view in FIG. 3 shows, are curved toward one another and merge with hook halves 14*a*, 14*b*. These hook halves rest on one another along an imaginary separation plane that is perpendicular to the needle back and is located centrally to both the needle 6 and the needle 7. The imaginary separation plane in FIG. 3, top, is thus located parallel to the plane of the drawing and in FIG. 3, bottom, it is perpendicular to the plane of the drawing. As can be seen, the hook 14 has a width which is somewhat greater than the width of the hook 15. The width is measured in each case between the side faces pointing away from one another. The hook halves 14*a*, 14*b* are held resiliently against one another by the spring legs 33, 34 and are embodied congruently.

Further details of the knitting tool 5 will become apparent from the ensuing function description, which can also be referred to for the dimensioning and the details of the first needle 6, second needle 7 and slide 12:

In a first mode of operation, only the first needle 6 is used to produce a knitted product. This process is shown in FIGS. 3 through 6. In FIG. 3, the hook 14 is carrying a loop from which a knitted product is suspended. The slide 12 can close the hook interior, or in other words can rest with its end 19 in the noucat 18, or can also begin to open the hook interior. The needle 7 is located essentially in the receiving chamber of the needle 6.

For embodying a further loop, the first needle 6 is now projected as far as its yarn insertion position. In the process, the existing loop 36 slides over the cheek elevation, possibly as far as the loop support 35. The slide 12 and the needle 7 are in the process received completely, or at least nearly completely, by the receiving chamber of the needle 6. A yarn is now inserted into the hook 14 and initially forms a stitch 37. FIG. 4 illustrates this.

Figures 7, 8, 9, 10:
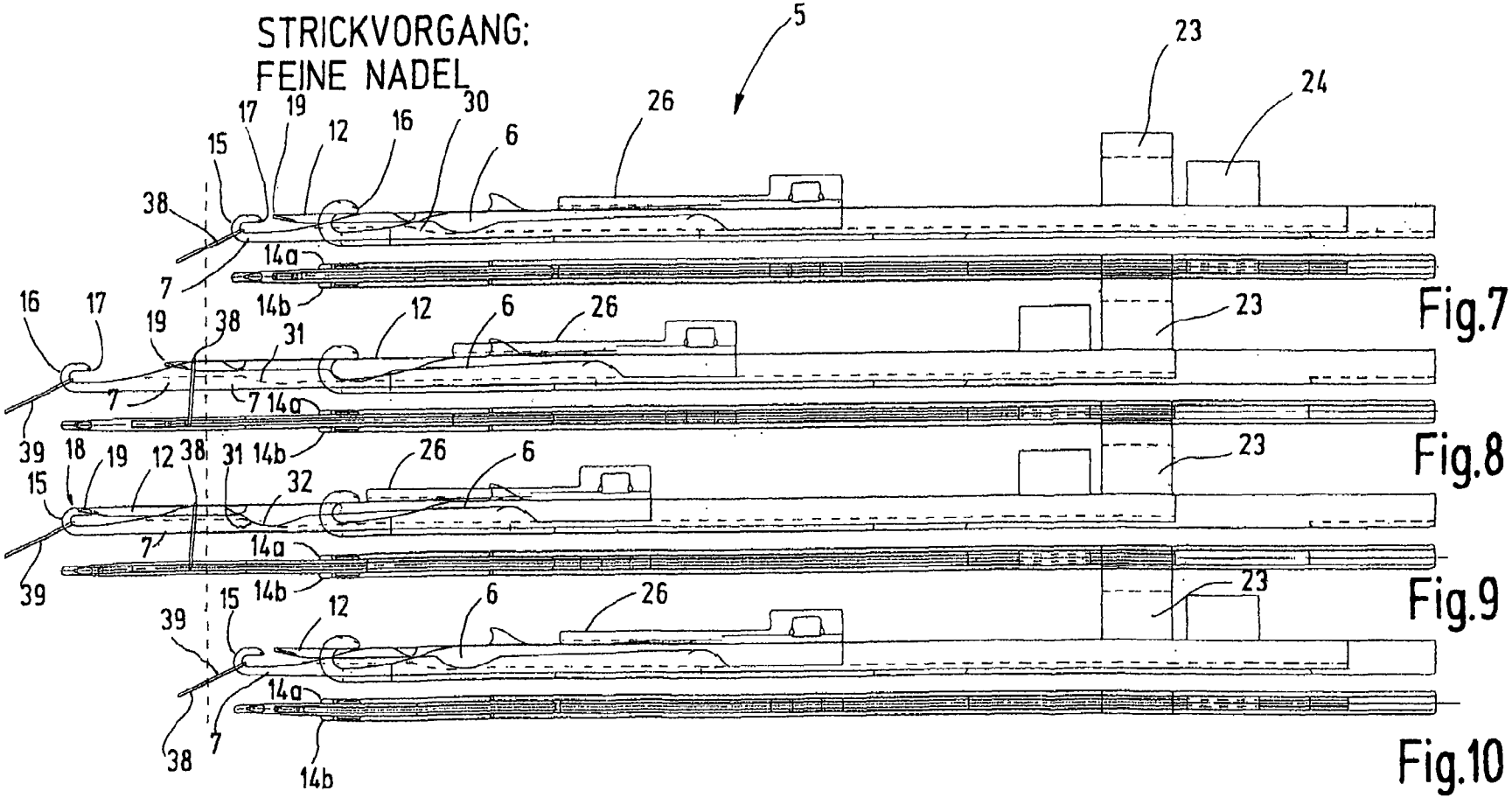

Once the stitch 37 is formed, the hook 14 is closed, because the slide 12, by suitable displacement of its butt 25, is thrust toward the hook 14 until its end 19 is located in the noucat 18. The needle 7 remains in the retracted position in the receiving chamber (FIG. 7).

If the large needle 6 is now retracted together with the slide 12 in the closed position into the position shown in FIG. 6, the loop 36 slides from the hook 14 over onto the stitch 37. A new loop 36 is formed. This accordingly creates the starting position for the knitting operation that now repeats as shown in FIG. 3.

In the so-called knockover operation described in conjunction with FIG. 6, the small needle 6 can be projected so far that its hook 15 is located in the interior of the hook 14. As a result, the slide 12 can experience a bracing action, which is overall advantageous for its load-bearing capacity. Accordingly, the hook 15 can have a bracing face on its top side facing toward the slide 12.

In a second mode of operation, only the second needle 7 of the knitting tool 5 is used for forming loops. The operation is illustrated in FIGS. 7 through 10. In all the knitting positions, the coarse needle 6 remains in the same retracted position, because its butt 23 is not moved. During the entire operation, the hook halves 14*a*, 14*b* are spread apart from one another by the second needle 7, thrust between them, and by the slide 12. The slide 12 is not projected past the hook 15 at any point. Thus its protrusion 32 always remains below the ramp 31; that is, the end 19 is never raised past the tip 17.

The knitting operation begins in the position shown in FIG. 7. The needle 7 is in the retracted position, but the needle 6 is still further retracted. An old loop 38 is located in the hook 15.

For receiving a new yarn, the needle 7 is now projected as far as its yarn insertion position. The slide 12 is retracted so far at this time that the old loop 38 can slide onto the shank elevation of the needle 7. FIG. 8 shows how the slide 12 is already beginning to close and with its back is taking over the loop 38. A new yarn is inserted into the hook 15 and now forms a stitch 39. Once the hook 15 is closed, when the end 19 of the slide 12 rests in the noucat 18, the slide 12 and the needle 7 can be moved synchronously backward (retracted), as a result of which the old loop 38 is now slipped over the stitch 39, which now forms the new old loop, whereupon the operation continues, beginning again in FIG. 7.

To assure that the end 19 of the slide 12 will remain securely held in the noucat 18, the receiving element 26 can prestress the slide 12 resiliently against the slot bottom 30. A corresponding spring action also permits the vertical slide motion, when this slide moves along the ramp 31.

FIGS. 11 through 15 illustrate a third mode of operation, in which a loop 40 is transferred from the fine needle 7 to the coarse needle 6. To that end, the coarse needle 6 is initially in the maximally retracted position, that is, in its basic position. The needle 7 is projected only slightly. The slide 12 is retracted.

Figures 11, 12, 13, 14, 15:
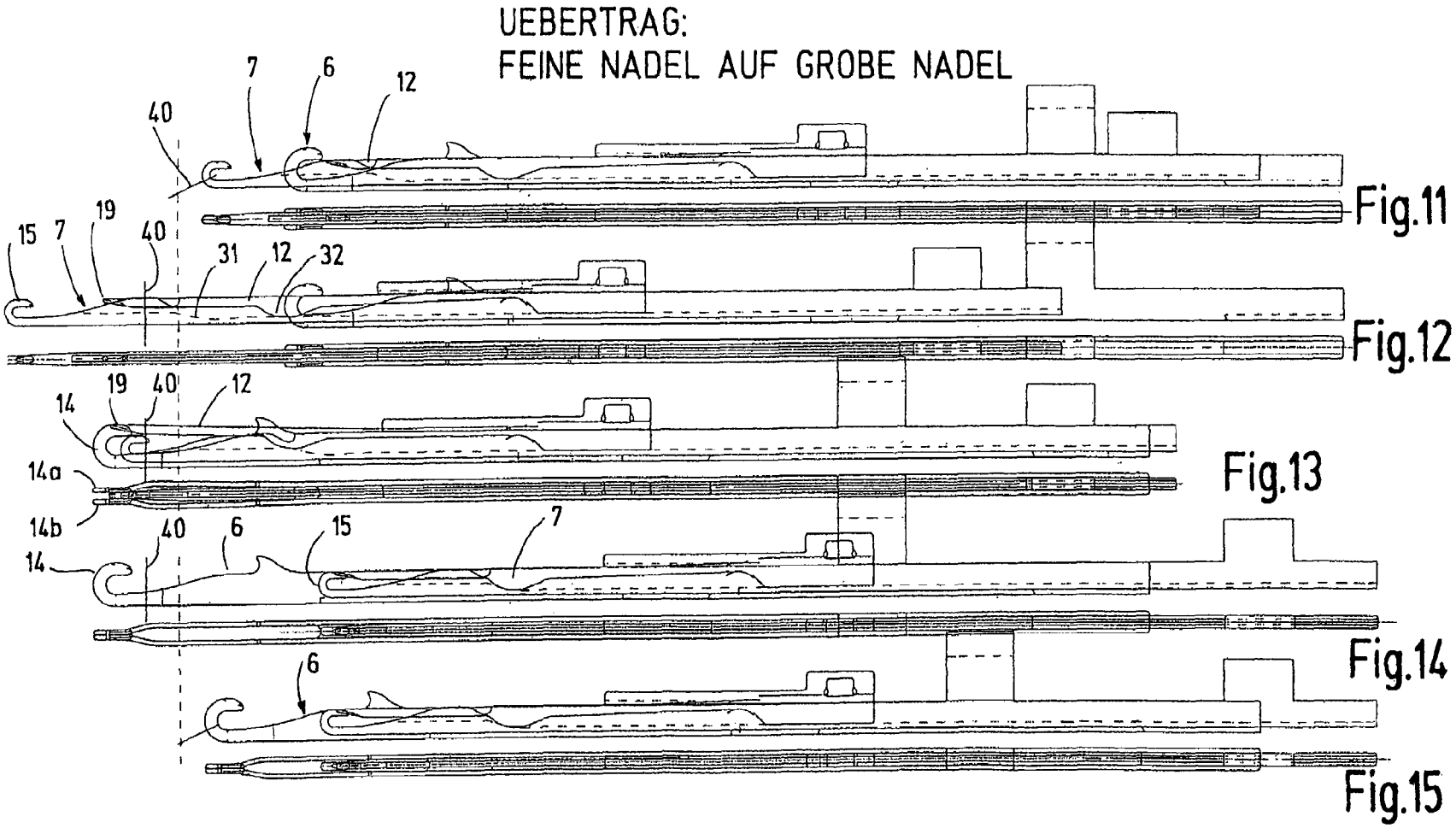

As FIG. 12 shows, first the needle 7 is projected so far that the loop 40 slides onto the shank elevation. The slide 12 is projected with it in the process, but its end 19 is concealed by the shank elevation. As can be seen from FIG. 12, it is now further projected, in order to take over the loop 40. The slide 12 at this time is in a lower position, at the level of the hook 15.

In the next step, the fine needle 7 is retracted and the large needle 6 is projected. As a result, the ramp 31 is pulled through and under the protrusion 32 of the slide 12; as a result it is raised to the level of the tip 16 of the hook 14. Simultaneously, the hook 14 with the needle 6 is driven in the projection direction, until it adjoins the end 19 of the slide 12. In the projection motion of the large needle 6, it is necessary for the loop 40, which surrounds the fine needle 7, to be widened so that it can pass over the wider hook 14 of the large needle 6. To that end, transfer means (not shown) in the form of chamfers on the hook 14 are recesses in the form of slots on the fine needle 7 or otherwise-shaped transfer means may be provided. In the process, the hook halves 14*a*, 14*b* come together, since they are now no longer being spread apart by the needle 7 (FIG. 13).

For transferring the loop 40 into the interior of the hook 14, the slide 12 and furthermore the needle 7 are now retracted to the maximum possible extent, and as a result they jointly enter all the way into the receiving chamber of the needle 6. The loop 40 drops into the hook 14 in the process. The needle 6, as FIG. 15 shows, can now be retracted into the basic position. This state can be assumed as the starting point for further operation in the first mode of operation (knitting with the coarse needle 6).

Figures 16, 17, 18, 19, 20:
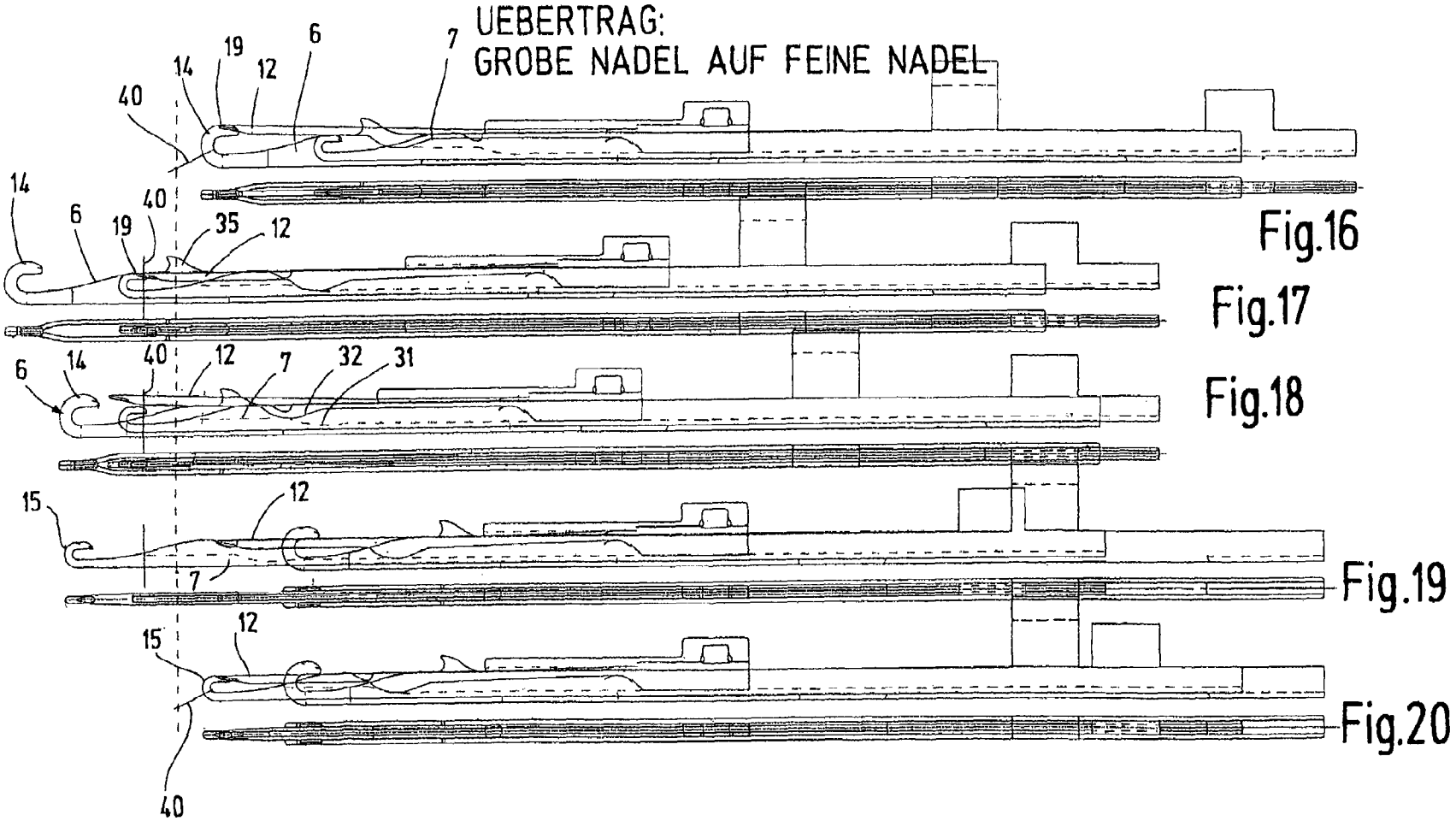

In a fourth mode of operation, shown in FIGS. 16 through 20, a loop 40 is transferred from the large needle 6 to the small needle 7. The starting point shown in FIG. 16 is first a loop 40 enclosed in the hook 14. The end 19 of the slide 12 closes the hook 14. The needle 7 is retracted extensively or completely into the receiving chamber of the needle 6. The hook 14 is now first opened, because the needle 6 is projected much farther than the slide 12 and the needle 7. As a result, the slide 12 disappears behind the cheek or shank elevation of the needle 6. The loop 40 can slide onto the shank of the needle 6, optionally as far as the loop support 35. The loop 40 in the process simultaneously passes over the end 19 of the slide 12 (FIG. 17). If the slide 12 is now projected while the needle 7 is in repose, the protrusion 32 moves along the ramp 31, and as a result the slide 12 is simultaneously raised from its bottom position at the level of the hook 15 to its top position at the level of the hook 14. It takes over the loop 40. By retraction of the needle 6, the hook 14 is moved through and out of the loop 40. The transition from FIG. 18 to FIG. 19 illustrates this motion of the needle 6 to its basic position. Simultaneously, the needle 7 is projected farther, and the slide 12 is retracted. As a result, the loop 40 drops into the open interior of the hook 15. The slide 12 returns to its lower position. If the needle 7 is now retracted, then the position shown in FIG. 20 is reached, with the closed hook 15 in whose interior the loop 40 is enclosed. This position can be assumed to be the starting position for the second mode of operation shown in FIG. 7 (knitting with the small needle 7).

Thus with the needle bed 2, knitting can selectively be done with the needles 7 and 11, and with the needles 6, and optionally also with the needles 6 and 11. Many variations are possible for designing different knitted products.

Figure 21:
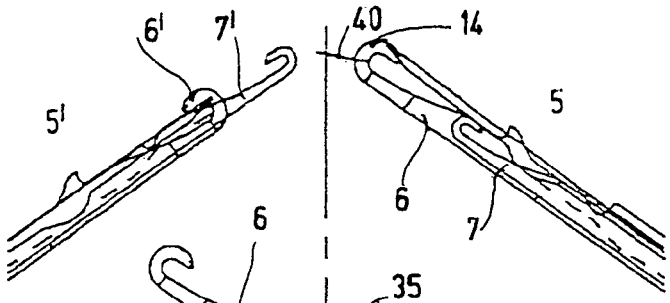
Figure 22:
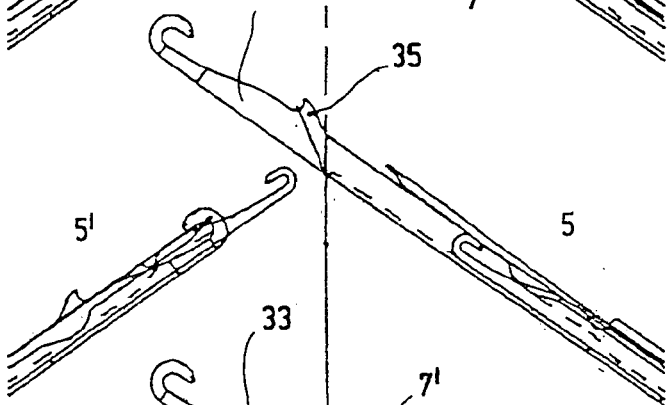
Figure 23:
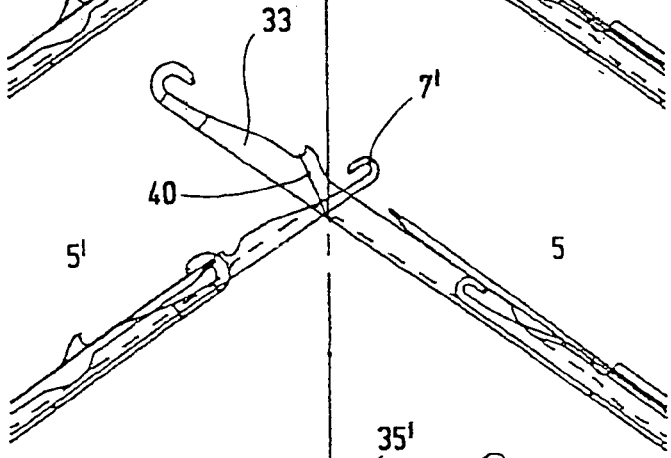
Figure 24:
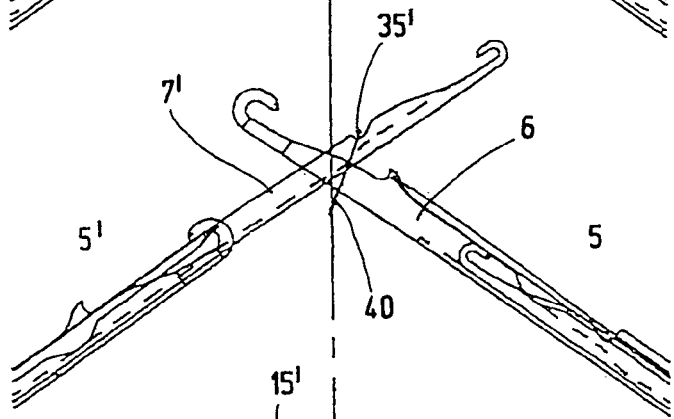
Figure 25:
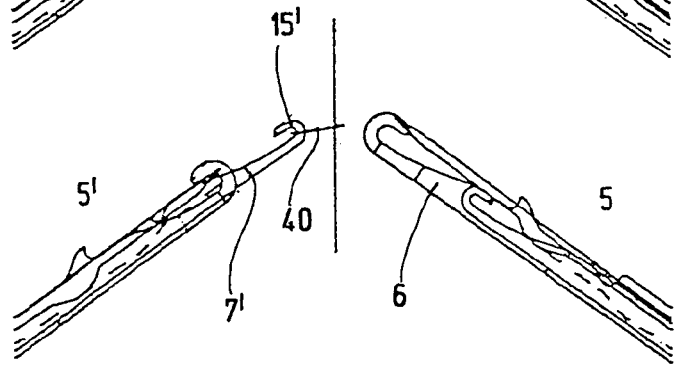

In a fifth mode of operation, shown in FIGS. 21 through 25, a loop 40 is transferred from the transferring coarse needle 6 of the combined knitting tool 5 to the fine takeover needle 7' of the combined knitting tool 5', which is located in the diametrically opposed needle bed. In FIG. 21, the starting point is first a loop 40 enclosed in the hook 14. The coarse needle 6 of the combined knitting tool 5 moves to the suspension position, in which the loop 40 is held out in front (FIG. 22) by the loop support 35 for the suspension operation. Next, the fine needle 7' of the combined knitting tool 5' is projected and punches between the spring legs 33, 34 of the combined knitting tool 5 and the loop 40 held out in front (FIG. 23). Now the coarse needle 6 of the combined knitting tool 5 is retracted so far that the loop 40 is transferred to the loop support 35' of the fine needle 7', which is still in the projected position, of the diametrically opposed needle bed (FIG. 24). In this state, the loop 40 loops around both the fine needle 7' and the coarse needle 6. After that, the coarse needle 6 of the combined knitting tool 5 retracts to its outset position, and as a result the loop 40 to be transferred now wraps around only the fine needle 7' of the combined knitting tool 5'. The fine needle 7' of the combined takeover knitting tool 5' now retracts to its basic position, and the taken-over loop 40 is now located in the hook 15' of the fine needle 7' of the combined takeover knitting tool 5' (FIG. 25).

In an alternative embodiment, both the fine needle 7 and the slide 12 travel in the slot of the first, coarse needle 6, and the tip of the slide is split in two and surrounds the second needle 7. For controlling the vertical motion, that is, the height-compensating motion, of the end of the slide, the slot of the first needle 6, for instance on its side walls, has a sliding control block, which is operative only for the slide 12 but not for the fine needle 7. The function of this embodiment is largely equivalent to the function of the embodiment described above.

A knitting tool which is suitable for embodying both large and small loops has two needles 6, 7, disposed coaxially to one another, whose hooks are oriented identically. The hook of the larger needle 6 is split in two in the middle and comprises hook halves. The finer needle 7 can be driven between the two hook halves upon spreading of the two hook halves apart from one another. For selectively closing the hooks, a slide is provided, which can be brought into engagement both with the tip of the fine needle and with the tip of the coarser needle. To raise and lower the slide to the various positions of the hook tips relative to the needle back, a sliding control block may be provided. The sliding control block may be embodied on the coarse needle and on the fine needle 7.

The invention claimed is:

1. A knitting tool comprising:

a first needle having a first hook; and a second needle having a second hook, wherein both of the first and second hooks are oriented identically and having a hook closing element, wherein the first and second needles and the closing element are located movably in translational fashion relative to one another, and wherein the first needle is larger than the second needle.

2. A knitting tool comprising:

a first needle having a first hook; and a second needle having a second hook, wherein both of the first and second hooks are oriented identically and having a hook closing element, wherein the first and second needles and the closing element are located movably in translational fashion relative to one another, and wherein the first needle has a receiving chamber for the second needle.

3. The knitting tool as defined by claim 2, wherein the second needle is retractable into the receiving chamber.

4. The knitting tool as defined by claim 2, wherein the receiving chamber is located centrally in the first needle.

5. A knitting tool comprising:

a first needle having a first hook; and a second needle having a second hook, wherein both of the first and second hooks are oriented identically and having a hook closing element, wherein the first and second needles and the closing element are located movably in translational fashion relative to one another, and wherein the hook of the first needle is split, and the hook of the second needle is preferably unsplit.

6. The knitting tool as defined by claim 5, wherein the split hook has two hook halves, which are supported by spring legs.

7. The knitting tool as defined by claim 6, wherein the hook halves are held in contact with one another along a separation face.

8. The knitting tool as defined by claim 6, wherein the hook halves are held in spreadable fashion by the spring legs.

9. The knitting tool as defined by claim 6, wherein the spring legs begin at a needle body, at which they are held in a fixed relationship to one another.

10. The knitting tool as defined by claim 2, wherein the receiving chamber is aligned with the hook.

11. The knitting tool as defined by claim 1, wherein the first needle has a hook that is bent with a radius; and that the second needle has a hook that is bent with a radius; and that the radius of the hook of the first needle is greater than the radius of the hook of the second needle.

12. The knitting tool as defined by claim 1, wherein the first needle has a hook with a width; and that the second needle has a hook with a width, measured in the same direction; and that the width of the hook of the first needle is greater than the width of the hook of the smaller needle.

13. The knitting tool as defined by claim 1, wherein the needles are supported displaceably against one another.

14. The knitting tool as defined by claim 1, wherein the closing element is a slide.

15. The knitting tool as defined by claim 1, wherein the first needle, the second needle, and the closing element are each individually in connection with a drive mechanism.

16. The knitting tool as defined by claim 15, wherein the drive mechanism is in each case a butt which is arranged to come into engagement with a needle track of a machine cam of a knitting machine.

17. A knitting tool comprising:

a first needle having a first hook; and a second needle having a second hook, wherein both of the first and second hooks are oriented identically and having a hook closing element, wherein the first and second needles and the closing element are located movably in translational fashion relative to one another, and wherein a loop support device is provided on the first needle.

18. The knitting tool as defined by claim 1, wherein a loop support device is provided on the second needle.

19. The knitting tool as defined by claim 1, wherein a loop support device is provided on the closing element.

20. The knitting tool as defined by claim 1, wherein the closing element is embodied as a slide; and that the slide is held in contact with a control cam for accomplishing a vertical motion.

21. The knitting tool as defined by claim 1, wherein the control track is embodied on the second needle.

22. The knitting tool as defined by claim 1, wherein the closing element is embodied as a slide; and that the slide can be projected through the hook of the first needle.

* * * * *